United States Patent [19]

Kanamori

[11] Patent Number: 4,537,241

[45] Date of Patent: Aug. 27, 1985

[54] METAL SUPPORTING STRUCTURE FOR CONTINUOUS CASTING MACHINES

[75] Inventor: Toshio Kanamori, Niihama, Japan

[73] Assignee: Sumitomo Heavy Industries, Ltd., Tokyo, Japan

[21] Appl. No.: 468,723

[22] Filed: Feb. 22, 1983

[30] Foreign Application Priority Data

Feb. 25, 1982 [JP] Japan ..... 57-024928[U]
Mar. 30, 1982 [JP] Japan ..... 57-044013[U]

[51] Int. Cl.[3] ..... B22D 11/12; B22D 11/124

[52] U.S. Cl. ..... 164/442; 164/441; 164/444; 164/447

[58] Field of Search ..... 164/441, 447, 444, 443, 164/442

[56] References Cited

U.S. PATENT DOCUMENTS 3,616,844 11/1971 Bick et al. ..... 164/441
3,654,989 4/1972 Meier et al. ..... 164/441 X
3,753,459 8/1973 Burkhardt et al. ..... 164/441 X
3,757,849 9/1973 Toperzer et al. ..... 164/447 X
3,882,924 5/1975 Fujikawa ..... 164/444 X
3,981,350 9/1976 Chielens et al. ..... 164/447
4,091,862 5/1978 Lehmann et al. ..... 164/441 X

FOREIGN PATENT DOCUMENTS 2017976 10/1971 Fed. Rep. of Germany ..... 164/447

*Primary Examiner*—Nicholas P. Godici
*Assistant Examiner*—J. Reed Batten, Jr.
*Attorney, Agent, or Firm*—Flynn, Thiel, Boutell & Tanis

[57] ABSTRACT

A metal supporting structure is disposed just beneath the mold of a continuous casting machine for supporting and cooling hot metal coming down from the mold. The structure comprises a backing frame which is disposed just beneath the mold of the continuous casting machine for defining a cavity leading from the exit of the mold. The backing frame is formed therein with a number of through openings. A number of spray nozzles are arranged at the back of the backing frame and which are directed to spray cooling water through the openings onto the skin of the metal being continuously drawn from the mold into the cavity of the backing frame. A wear lining is disposed to line the inner wall of the backing frame.

19 Claims, 8 Drawing Figures

METAL SUPPORTING STRUCTURE FOR CONTINUOUS CASTING MACHINES

BACKGROUND OF THE INVENTION

1. Field of the Invention

The present invention relates to a continuous casting machine and, more particularly, to a structure which is disposed just beneath the mold of the continuous casting machine for supporting and cooling hot metal coming down from the mold.

2. Description of the Prior Art

A supporting structure of the prior art, which is disposed just beneath the mold of a continuous casting machine, has the construction in which a backing frame has its inner wall lined with a wall plate. This wall plate is formed with openings, through which nozzles for spraying cooling water face the skin of hot metal from the side of the backing frame. Moreover, the metal drawn from the mold of the continuous casting machine is supported by the whole inner surface of the wall plate excepting those openings. As a result, there arise two problems, i.e., accumulation of scale within the openings and insufficient cooling of the continuous wall plate. Specifically, the scale, which may be peeled or scraped off the skin of the metal, accumulates within the openings to clog the spray nozzles so that the metal cannot be uniformly cooled down. This causes surface flows such as fissures. The second problem of the insufficient cooling arises because the wall plate contacting the metal over a large surface area is adversely affected by the heat which is transferred from the hot metal. Then, this wall plate is frequently thermally deformed or fissured. As a result, the distance between the opposing wall plates changes so that the upper portion of the wall plate in the vicinity of the mold located at the top is offset from the lower portion of the same guided by guide rollers located at the bottom. This gives rise to the resistance of the metal to the draw and may lead to a serious failure such as metal breakout.

SUMMARY OF THE INVENTION

It is, therefore, an object of the present invention to provide a structure adapted to be disposed just beneath the mold of a continuous casting machine for supporting and cooling hot metal coming down from the mold, which structure is freed of any of the aforementioned drawbacks concomitant with the prior art.

Another but major object of the present invention is to provide a supporting structure which is prevented from such accumulation of scale as will trouble cooling water spray nozzles and which can be so sufficiently cooled down that its metal supporting elements can enjoy improved durability.

According to a feature of the present invention, there is provided a structure for supporting and cooling hot metal coming down from the mold of a continuous casting machine, said structure comprising: a backing frame disposed just beneath the mold of said continuous casting machine for defining a cavity leading from the exit of said mold, said backing frame being formed with a multiplicity of through openings; a multiplicity of spray nozzles arranged at the back of said backimg frame and directed to spray cooling water through the openings of said backing frame onto the skin of the metal being continuously drawn from said mold into the cavity of said backing frame; and a wear lining disposed to line the inner wall of said backing frame and including a multiplicity of metal supporting elements which are arranged to be arrayed in a staggered form and to protrude inwardly from the inner wall of said backing frame thereby to have their inner end faces providing such a substantially continuous wall surface extending longitudinally of said structure within the cavity of said backing frame as to define a metal guide passage cooled down sufficiently with the water vapors spurting from said spray nozzles so that said wall surface can contact and rigidly support the metal being guided therein and which are so distantly spaced from one another as to allow, while ensuring their rigid support, the water vapors to be released therearound upward and the scale, which might otherwise accumulate to clog said spray nozzles, to be carried therearound downward by the fall of the water.

According to another feature of the present invention, the metal supporting elements of said wear lining are wear blocks which are arranged in a plurality of horizontal rows each having its blocks staggered from those of any adjacent row.

According to still another feature of the present invention, said wear lining further includes a wear plate lining the inner wall of said backing frame and having a multiplicity of through openings coextensive with those of said backing frame, and the metal supporting elements of said wear lining are protrusions which protrude from the inner wall of said wear plate and which are arranged in a plurality of horizontal rows each having its protrusions staggered from those of any adjacent row, whereby said protrusions can be replaced as a whole by another set together with said wear plate.

BRIEF DESCRIPTION OF THE DRAWINGS

Other objects, advantages and features of the present invention will become apparent from the following description taken with reference to the accompanying drawings, in which.

DESCRIPTION OF THE PREFERRED EMBODIMENTS

Figure 1:
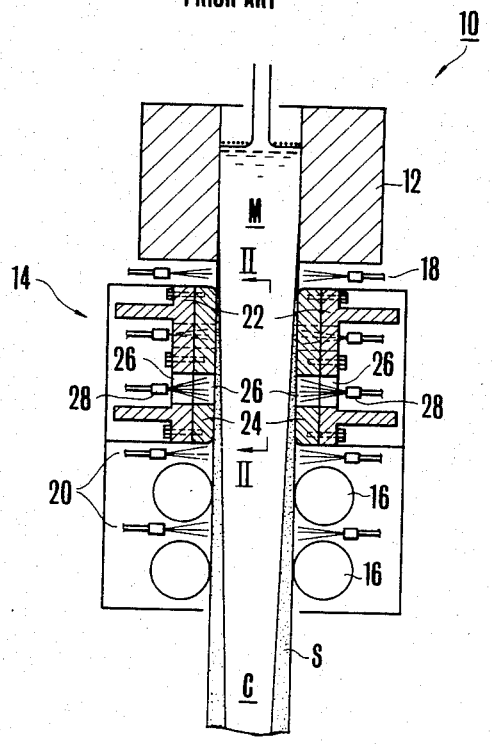
FIG.1 PRIOR ART
FIG. 1 is a schematic longitudinal section showing a metal supporting structure to be disposed just beneath the mold of a continuous casting machine according to the prior art as well as the mold and guide rollers, which are arranged above and below the supporting structure.

Before entering into the detailed description of the preferred embodiments of the present invention, cursory review will be made about one of the supporting structures for use in a continuous casting machine according to the prior art with reference to FIGS. 1 and 2. The continuous casting machine 10 is generally constructed, as customary, of a mold 12, a supporting structure 14, plural pairs of guide rollers 16, paired upper spray nozzles 18, and paired lower spray nozzles 20. Hot metal M is continuously drawn from the mold 12 into the supporting structure 14. The hot metal M is first cooled in a direct manner with the water vapors which are sprayed by the upper spray nozzles 18. The metal M is then introduced into the supporting structure 14 which is disposed just beneath the mold 12. The metal M thus introduced is allowed to travel downward, while being supported and directly cooled by the supporting structure 14, until it is transformed into a casting C as it proceeds down while being further cooled by the lower spray nozzles 20 and guided by the guide rollers 16.

Figure 2:
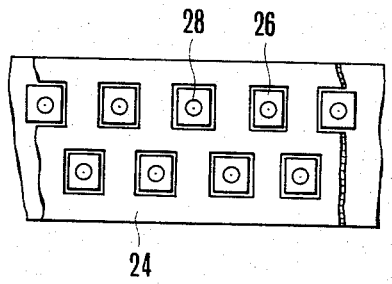
FIG.2 PRIOR ART
FIG. 2 is a side elevation taken in the direction of arrows II—II of FIG. 1.

As better seen from FIG. 2, the supporting structure 14 has the construction, in which a backing frame 22 has its inner wall lined with a wall plate 24. This wall plate 24 is formed with openings 26, through which nozzles 28 for spraying cooling water face the shell or skin S of the metal M from the side of the backing frame 22. Moreover, the metal M is supported by the whole inner surface of the wall plate 24 excepting those openings 26. As a result, there arise two problems, i.e., accumulation of scale within the openings 26 and insufficient cooling of the wall plate 24. Specifically, the scale, which may be peeled or scraped off the skin of the metal M, accumulates within the openings 26 to clog the spray nozzles 28 so that the metal M cannnot be uniformly cooled down any more. This causes surface flaws such as fissures. The second problem of the insufficient cooling arises because the wall plate 24 contacting the metal M in its entirety is adversely affected by the heat which is transferred from the hot metal M. Then, this wall plate 24 is frequently thermally deformed or fissured. As a result, the distance between the opposing wall plates 24 changes so that the upper portion of the wall plate 24 in the vicinity of the mold 12 located at the top is offset from the lower portion of the same guided by the guide rollers 16 located at the bottom thereof. This gives rise to the resistance of the metal M to the draw and may lead to a serious failure such as metal breakout.

Figure 3:
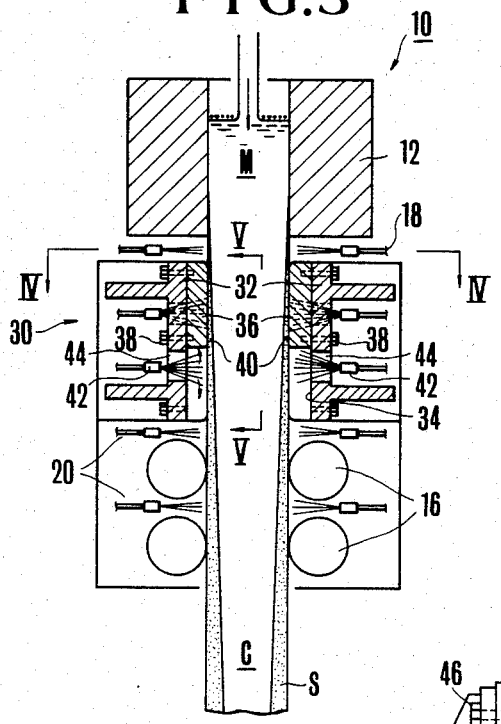
FIG. 3 is also a schematic vertical section showing a metal supporting structure according to the present invention as well as the mold and the guide rollers of a continuous casting machine.
Figure 4:
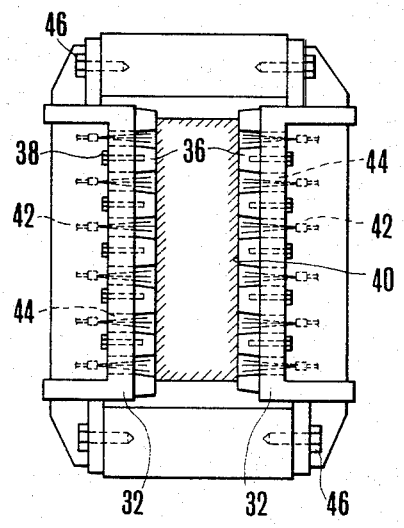
FIG. 4 is a top plan view taken in the direction of arrows IV—IV of FIG. 3.
Figure 5:
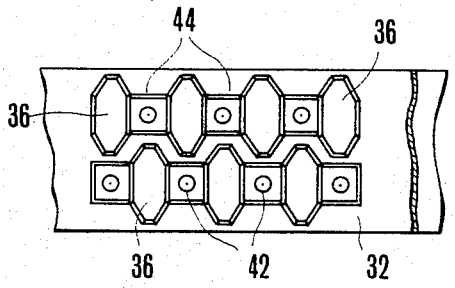
FIG. 5 is similar to FIG. 2 but is taken in the direction of arrows V—V of FIG. 3.

Turning now to FIGS. 3 to 5 showing a first embodiment of the present invention, identical reference numerals and letters designate identical or similar parts or materials appearing in FIGS. 1 and 2. A supporting structure generally indicated at numeral 30 is equipped with a backing frame 32 which is disposed just beneath or downstream of the mold 12 of the continuous casting machine 10. The backing frame 32 defines therein a cavity 34 which leads from the exit of the mold 12. The backing frame 32 has its inner wall lined with a number of metal supporting elements or octagonal wear blocks 36. These wear blocks 36 are removably fastened to the backing frame 32 by means of bolts 38 and are arranged to be arrayed in a horizontally staggered form and to protrude inwardly from the inner wall of the backing frame 32. The inner end faces of the wear blocks 36 provide a substantially continuous wall surface which extends longitudinally of the supporting structure 30 within the cavity 34 of the backing frame 32. As a result, the continuous wall surface defines a metal guide passage 40, which is sufficiently cooled down with the water vapors spurting from spray nozzles 42, so that it can contact and rigidly support the metal M being guided in the metal guide passage 40. With closer reference to FIG. 5, the wear blocks 36 having an equal size to provide an equal end face area are arranged in two or more rows in which they are staggered from those of any adjacent horizontal row. The spray nozzles 42 are arranged at the back of the backing frame 32 and are directed to spray cooling water through the openings 44, which are formed in the backing frame 32, onto the skin S of the metal M being continuously drawn within the cavity 40 of the backing frame 32. Here, each of the spray nozzles 42 is interposed between the adjacent wear blocks 36 of each row and between the corresponding wear blocks 36 of every two alternate rows, if these rows are three or more. Moreover, the wear blocks 36 are so distantly spaced from one another that they allow, while ensuring their rigid support, the water vapors to be released therearound upward and the water droplets to fall therearound downward. As best shown in FIG. 4, the wear blocks 36 are tapered inward to define such inwardly diverging spaces inbetween that the water vapors may be injected in the form of jets from the spray nozzles 42. Incidentally, indicated at reference numeral 46 are bolts by which the backing frame 32 can be removably fastened together with the wear blocks 36 to the supporting structure 30. As shown in FIG. 5, the wear blocks have upper edge portions which taper in an upward direction and lower edge portions which taper in a downward direction.

Thanks to the construction of the supporting structure 30 thus far described, the metal M, which is continuously drawn from the mold 12, is allowed to travel downward while being supported by the wear blocks 36 and cooled down with the water vapors injected from the spray nozzles 42. The metal M is gradually cooled down into the casting C with its skin S gradually growing hard or rigid as it is successively guided downward by the guide rollers 16.

In the course of the metal travel, the cooling water is sprayed by the spray nozzles 42 through the openings 44 formed in the backing frame 32 thereby to cool down the metal M. Most of the cooling water, which has rebounded from skin S of the metal M, i.e., the water droplets can fall down through the water formed passages between the wear blocks 36. In this meanwhile, therefore, the cooling water functions to cool down the wear blocks 36 and to wash and carry away the scale which may be peeled or scraped off the metal skin S and which might otherwise accumulate to clog the spray nozzles 42. As a result, these nozzles 42 are not troubled in the least so that the metal M can be uniformly cooled down. Moreover, although the wear blocks 36 provide a smaller metal supporting surface area so that it has to endure a higher pressure than the wall plate of the prior art, they are so sufficiently cooled down that they can be freed of any deterioration in hardness thereby to suppress their wear. Thanks to the small contact area, the wear blocks 36 are subjected to reduced heat transfer so that they can be prevented from being thermally deformed or fissured. As a result, the wear blocks 36 can enjoy outstanding durability.

Figure 6:
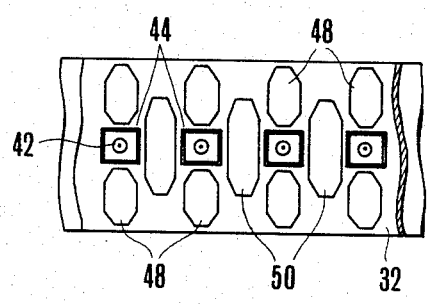
FIG. 6 is similar to FIG. 5 but shows a modification of the arrangement of the supporting structure.

The supporting structure 30 thus far described with reference to FIGS. 3 to 5 may be modified such that the wear blocks are arranged in three horizontal rows, as shown in FIG. 6. The upper and lower rows are composed of shorter wear blocks 48 whereas the intermediate row is composed of longer wear blocks 50. According to this modified arrangement, each of the spray nozzles 42 is arrayed in the intermediate row of the wear blocks 50 and is interposed between the corresponding wear blocks 48 of the upper and lower rows and between the adjacent wear blocks 50 of the intermediate row, i.e., in each alternate row if the rows are three or more.

Although not shown, it should be understood that the numbers and sizes of and the spacings between the wear blocks can be modified in various ways so that the smooth flows of the falling water may be ensured, provided that the wear blocks are arranged in plural horizontal rows in which the blocks are staggered from those of any adjacent row.

Figure 7:
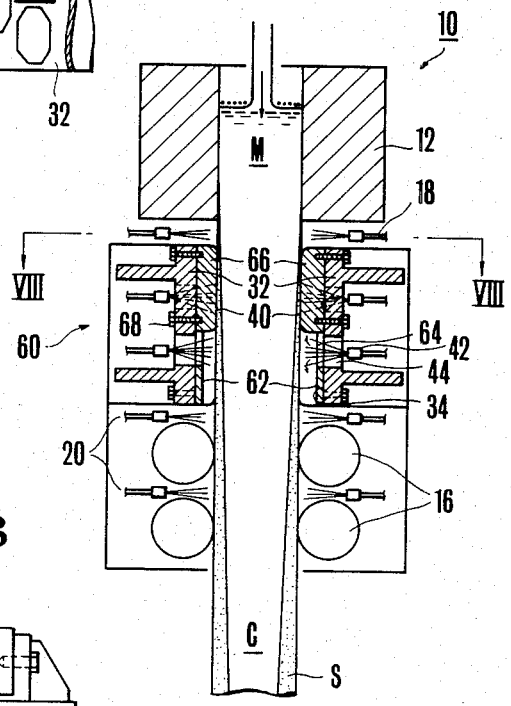
FIG. 7 is similar to FIG. 3 but shows a second embodiment of the present invention.
Figure 8:
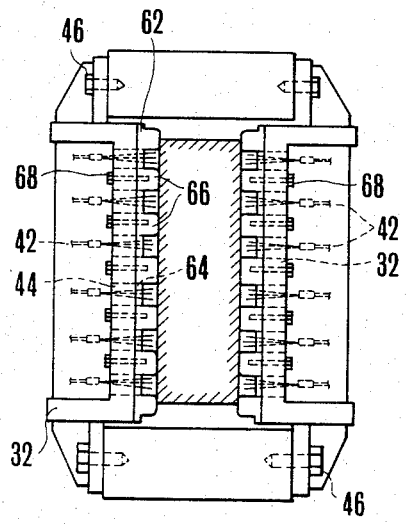
FIG. 8 is similar to FIG. 4 but is taken in the direction of arrows VIII—VIII of FIG. 7.

Turning now to FIGS. 7 and 8 showing a second embodiment of the present invention, identical reference numerals and letters designate identical or similar parts or materials appearing in FIGS. 3 and 4. A supporting structure according to this second embodiment is generally indicated at numeral 60 and is also equipped with the backing frame 32 which is disposed just beneath or downstream of the mold 12 of the continuous casting machine 10. The backing frame 32 also defines therein the cavity 34 which leads from the exit of the mold 12. The backing frame 32 has its inner wall lined with a wear plate 62 which is formed with through openings 64 coextensive with the openings 44 of the backing frame 32. The wear plate 62 is equipped with a number of metal supporting elements or protrusions 66 for contacting and supporting the metal M being drawn. Those protrusions 66 protruding from the inner wall of the wear plate 62 are arranged in a plurality of horizontal rows in which the protrusions 66 are staggered like the wear blocks 36 of FIGS. 3 and 4 from those of any adjacent row. Here, the protrusions 66 may preferably be made integral with or anchored at the inner wall of the wear plate 62, which is removably fastened by means of bolts 68 to the inner wall of the backing frame 32. As a result, the protrusions 66 can be replaced as a whole by another set together with the wear plate 62 merely by loosening the bolts 68. The inner end faces of the protrusions or the metal supporting elements 66 also provide a substantially continuous wall surface which extends longitudinally of the supporting structure 60 within the cavity 34 of the backing frame 32. As a result, the continuous wall surface also defines the metal guide passage 40, which is sufficiently cooled down with the water vapors spurting from the spray nozzles 42 through the coextensive openings 44 and 64, so that it can also contact and rigidly support the metal M being guided in the metal guide passage 40. The spray nozles 42 are arranged at the back of the backing frame 32 and are directed to spray the cooling water through the openings 44 and 64, which are formed in the backing frame 32 and the wear plate 62, respectively, onto the skin of the metal M. The arrangements and shapes of the protrusions 66 and the spray nozzles 42 may be respectively similar to those of the wear blocks 36 and the spray nozzles 42 shown in FIGS. 3 and 4. For example, the protrusions 66 may be arranged in any of the arrays shown in FIGS. 5 to 6.

According to the present invention, as has been described hereinbefore, the metal supporting members of the supporting structure disposed just beneath the mold of the continuous casting machine can enjoy remarkably improved durability and can be freed from any trouble in the nozzles and accordingly from any irregular cooling operation. As a result, the present invention should be highly appreciated in that castings having no surface fissures can be efficiently produced under safe operating conditions.

What is claimed is:

1. A structure for supporting and cooling a continuous cast metal strand after it is discharged from a continuous casting mold, comprising: a backing frame having interior wall means defining a downwardly extending cavity, said backing frame having exterior wall means remote from said cavity and a multiplicity of spaced-apart through openings extending through said backing frame from said exterior wall means to said interior wall means; a multiplicity of spray nozzles arranged adjacent to said exterior wall means of said backing frame and arranged to spray cooling water through said openings into said cavity; a wear lining on the interior wall means of said backing frame, said wear lining comprising a multiplicity of metal-supporting elements protruding inwardly into said cavity from said interior wall means of said backing frame, said metal supporting elements having inner end faces adapted to contact and support the cast metal strand and defining a guide passage that conforms to the shape of the cast metal strand, said metal supporting elements being spaced apart from each other and being spaced from said openings so as not to obstruct spraying of said cooling water through said openings into said guide passage, said metal supporting elements being arrayed in horizontally and vertically spaced-apart, staggered relationship to each other, said metal supporting elements being of a generally octagonal shape and having upper edge portions which taper in an upward direction and having lower edge portions which taper in a downward direction so as to permit water easily to flow downwardly in said guide passage and to permit water vapor generated by contact of water with the cast metal strand to escape upwardly in said guide passage, the upper and lower edge portions of adjacent vertically spaced-apart metal supporting elements being in vertically overlapping relationship so that vertically continuous support for the cast metal strand is provided by said metal supporting elements.

2. A structure according to claim 1, wherein the metal supporting elements of said wear lining are wear blocks which are arranged in a plurality of horizontal rows which are vertically offset from each other, each row having its blocks offset horizontally from those of the adjacent rows.

3. A structure according to claim 2, wherein each of said spray nozzles is interposed between a pair of adjacent wear blocks of each row.

4. A structure according to claim 2, wherein each of said spray nozzles is interposed between a pair of corresponding wear blocks of two alternate rows.

5. A structure according to claim 2, wherein each of said spray nozzles is surrounded by four wear blocks which belong to three adjacent rows.

6. A structure according to claim 2, wherein each of said spray nozzles is interposed between adjacent wear blocks of alternate rows.

7. A structure according to claim 2, wherein the wear blocks of one row have a larger size than that of the wear blocks of an adjacent row.

8. A structure according to claim 2, wherein the wear blocks are tapered inwardly to define inwardly diverging spaces through which the water can be injected in the form of jets.

9. A structure according to claim 1, wherein said wear lining further includes a wear plate lining the interior wall means of said backing frame and having a multiplicity of through openings coextensive with those of said backing frame, and wherein the metal supporting elements of said wear lining are protrusions which protrude integrally from the inner wall of said wear plate and which are arranged in a plurality of horizontal rows which are vertically offset from each other, each row having its protrusions staggered from those of any adjacent row.

10. A structure according to claim 9, wherein each of said spray nozzles is interposed between a pair of adjacent protrusions of each row.

11. A structure according to claim 9, wherein each of said spray nozzles is interposed between a pair of corresponding protrusions of two alternate rows.

12. A structure according to claim 9, wherein each of said spray nozzles is surrounded by four protrusions which belong to three adjacent rows.

13. A structure according to claim 9, wherein each of said spray nozzles is interposed between adjacent protrusions of alternate rows.

14. A structure according to claim 9, wherein the protrusions of one row have a larger size than that of the protrusions of an adjacent row.

15. A structure according to claim 9, wherein the protrusions are tapered inwardly to define inwardly diverging spaces through which the water can be injected in the form of jets.

16. A structure as claimed in claim 2 in which the upper edge portions of the metal supporting elements in each row are interposed between and are vertically overlapped with the lower edge portions of the metal supporting elements in the adjacent upper row, and the lower edge portions of the metal supporting elements in each row are interposed between and are vertically overlapped with the upper edge portions of the metal supporting elements in the adjacent lower row.

17. A continuous casting machine comprising a downwardly opening mold for casting a continuous metal strand, a structure for supporting and cooling the cast metal strand after it is discharged from said continuous casting mold, comprising: a backing frame having interior wall means defining a downwardly extending cavity extending away from said mold, said backing frame having exterior wall means remote from said cavity and a multiplicity of spaced-apart through openings extending through said backing frame from said exterior wall means to said interior wall means; a multiplicity of spray nozzles arranged adjacent to said exterior wall means of said backing frame and arranged to spray cooling water through said openings onto the cast metal strand that is moving through said cavity; a wear lining on the interior wall means of said backing frame, said wear lining comprising a multiplicity of metal-supporting elements protruding inwardly into said cavity from said interior wall means of said backing frame, said metal supporting elements having inner end faces adapted to contact and support the cast metal strand and defining a guide passage that conforms to the shape of the cast metal strand, said metal supporting elements being spaced apart from each other and being spaced from said openings so as not to obstruct spraying of said cooling water through said openings into said guide passage, said metal supporting elements being arrayed in horizontally and vertically spaced-apart, staggered relationship to each other, said metal supporting elements being of a generally octagonal shape and having upper edge portions which taper in an upward direction and having lower edge portions which taper in a downward direction so as to permit water easily to flow downwardly in said guide passage and to permit water vapor generated by contact of water with said cast metal strand to escape upwardly in said guide passage, the upper and lower edge portions of adjacent vertically spaced-apart metal supporting elements being in vertically overlapping relationship to that vertically continuous support for the cast metal strand is provided by said metal supporting elements;

a plurality of guide rollers disposed below said structure for guiding the cast metal strand after it leaves said structure;

a plurality of upper spray nozzles between said structure and said mold for spraying water onto the cast metal strand in order to cool said strand; and a plurality of lower spray nozzles associated with said guide rollers for spraying water onto the cast metal strand in order to cool said strand.

18. A continuous casting machine according to claim 17, wherein the metal supporting elements of said wear lining are wear blocks which are arranged in a plurality of horizontal rows which are vertically offset from each other, each row having its blocks offset horizontally from those of any adjacent row.

19. A continuous casting machine according to claim 17, wherein said wear lining further includes a wear plate lining the inner wall of said backing frame and having a multiplicity of through openings coextensive with those of said backing frame, and wherein the metal supporting elements of said wear lining are protrusions which protrude integrally from the inner wall of said wear plate and which are arranged in a plurality of horizontal rows which are vertically offset from each other, each row having its protrusions horizontally offset from those of any adjacent row.

* * * * *